US005118117A

United States Patent [19]

Denen

[11] Patent Number: 5,118,117

[45] Date of Patent: Jun. 2, 1992

[54] RECREATIONAL DART

[75] Inventor: Dennis J. Denen, Columbus, Ohio

[73] Assignee: Progenics Corporation, Columbus, Ohio

[21] Appl. No.: 638,777

[22] Filed: Jan. 8, 1991

[51] Int. Cl.[5] ..... A63B 65/02

[52] U.S. Cl. ..... 273/420

[58] Field of Search ..... 273/416, 419, 420

[56] References Cited

U.S. PATENT DOCUMENTS

| | | | |
|---|---|---|---|
| 4,032,147 | 6/1977 | Sheldon, Jr. | 273/416 |
| 4,842,285 | 6/1989 | Farler | 273/420 |
| 4,900,038 | 2/1990 | Czetto et al. | 273/416 |
| 5,009,433 | 4/1991 | Reid | 273/419 |

FOREIGN PATENT DOCUMENTS

| | | | |
|---|---|---|---|
| 2029711 | 3/1980 | United Kingdom | 273/416 |
| 1593047 | 7/1981 | United Kingdom | 273/420 |
| 2224663 | 5/1990 | United Kingdom | 273/420 |

*Primary Examiner*—Paul E. Shapiro
*Attorney, Agent, or Firm*—Mueller and Smith

[57] ABSTRACT

A recreational dart is described which includes a body portion or barrel which is hollow and within which there is provided a spring bias mass which exhibits a momentum during the flight of the dart towards a target. As the dart reaches the target and the point commences to be embedded therein, the mass slides forwardly against a retaining spring to impart its momentum to the dart somewhat in the manner of a dead blow hammer. The point of the dart is retained in a normal position aligned with the central axis of the dart body by a spring contained within the dart body. Should the point strike a non-yielding portion of a target such as a wire scoring boundary, the point will be permitted to deflect and retract rearwardly until striking a camming surface which enhances its off axis orientation and thus permits the dart to slide off of the boundary wire and enter the target to avoid "bounce out".

30 Claims, 3 Drawing Sheets

RECREATIONAL DART

BACKGROUND OF THE INVENTION

In his comprehensive treatise Darts, Keith Turner has estimated that darts are thrown by 20 million or so aficionados in the United States alone at levels ranging from friendly games at local pubs to organized, often highly lucrative, professional tournaments. Notwithstanding the level at which the game is enjoyed, the play and its players are highly competitive. Attendant with this competition has come a demand from throwers of all abilities for a dart offering better performance than those heretofore known.

A modern dart can be divided into four functionally distinct components: the point, the barrel or body component, the shaft or item, and the flight. The point is the business end of the dart that effects its penetration into the board. Accordingly, the point typically is made of a hard material such as high tensile steel that can be ground to a sharp tip to lessen the frictional forces that oppose its entry into the board. However, for certain automatic scoring target applications, the point may be formed of plastic for the purpose of avoiding target damage.

The barrel or body component, into which the point is embedded, supplies a grip for the thrower and the principal weight to carry the dart to the board and to sink the tip of the point thereinto. In order to keep its cross-sectional area to a minimum, thereby maximizing the amount of board open to subsequent throws, for higher quality darts, the barrel is generally machined from a dense metal such as brass or titanium. The remainder of the body of the dart consists of a tapered shaft or stem which serves to hold the flight the correct distance from the barrel. Unlike the barrel, the shaft is composed of a lightweight material such as aluminum, fiberglass or graphite to minimize the moment of inertia or torque to which the point is subject subsequent to penetration into the board. Wedged into the distal end of the shaft is the flight. Traditionally composed of three or four feathers disposed in a symmetrical fashion, the flight imparts the aerodynamic stability necessary to keep the dart true to its path. Modern darts often substitute plastic or paper, but feathers are still preferred because they allow another dart to pass through and strike the board instead of being deflected. Additionally, the natural curvature of the feathers in relation to the shaft imparts an accuracy-improving rotational motion to the dart much as rifling in a gun barrel does to a bullet.

The demand from the throwers for a more competitive dart has been partially addressed by the substitution of the wood, feathers, and cane materials of years past with the titanium, polymers, and graphite of the present. However, although more advanced materials of construction of the dart's components has increased performance somewhat, little has been done to further improve performance through modifications affecting the very mechanics and dynamics of the dart itself.

In scientific terms, a dart is basically a projectile whose flight from the thrower's hand to the board is governed by the laws of aerodynamics and physics. During flight, the gravitational forces acting upon the relatively massive, forwardly disposed body component and point are counter-balanced by the lift and air resistance provided by the rearwardly disposed flight. Upon impact with the board, the tip of the point, driven by the inertia of the barrel, spreads the densely-packed bristle fibers or the rolled paper of which the surface of the typical board is comprised to form a hole into which the point can penetrate. If the momentum and consequent impact energy of the dart exceeds a threshold value, its point will achieve a penetration sufficient to withstand the gravitational influences pulling the dart downward, and the dart will remain imbedded in the board.

Of utmost importance in the game is the need for a dart to remain in the board once it strikes it. The most accurately thrown dart is wasted if its penetration into the board is insufficient to hold the dart in place. Using heavier darts helps to increase penetration, but a sport limitation of 42 grams, as well as the need to keep the cross-sectional area of the barrel to a minimum preclude the adding of weight as a method to improve performance. Moreover, increasing the weight of the dart or providing a harder, sharper tip is ineffective in instances where penetration failure is a result of the tip striking one of numerous metal wires which divide the board into its various scoring sections. Accordingly, it can be seen that if further advancements in dart performance are to be achieved, they must result from more than merely supplanting the dart's current materials of construction with newer ones. Rather, the improvements must be gleaned from a mechanistic approach.

Recently, mechanistic innovations in darts have surfaced. A dart marketed under the trade designation "VARIANT" incorporates a hollow barrel with a weight moveable therein that enables the thrower to custom balance the dart's weight distribution to suit his or her own particular throwing style. Another dart, marketed under the trade designation "SCORPION," includes a spring-loaded point that, during dislocation of the dart from the board, can be triggerably retracted into the barrel to facilitate removal. Also, a dart marketed under the trade designation "HAMMERHEAD" features a point that, upon impact, recoils into the barrel where a contacting surface communicates with a corresponding contacting surface of the proximal end of the point so as to effect a driving action that is said to provide better tip penetration into the board and thereby reduce "bounce-outs."

However, notwithstanding the aforementioned mechanistic developments, the dart manufacturing industries have failed to adequately address the more persistent, and prevalent problem in the game of darts: that of an ostensibly accurate and sufficiently momentous dart failing to achieve penetration into the board as a result of its point tip striking of one of the board's metal or plastic score boundary dividing wires. Inasmuch as a dart that bounces off this non-yielding region of the board is a dart and possibly a game lost, there exists a continuing need for a dart structure which solves or mitigates this problem.

SUMMARY

The present invention relates to a recreational dart that minimizes the "bounce out" phenomenon wherein an accurate dart fails to count as a scoring throw as a result of its impact with and recoil from one of the metal or plastic wires which divided the board into its various scoring regions. This has been accomplished in the present invention by employing a point which is controllably deflectable from its normal position in alignment with a longitudinal axis of the dart to a new orientation a predetermined angle offset from the axis. The new orientation affords the dart a second opportunity to contact a region of the board unobstructed by a boundary wire. Consequently, a dart which heretofore would surely be lost now, with the instant invention, has a high probability of counting as a scoring throw. Thus, a player throwing darts utilizing the present invention can expect to accrue higher scores without any improvement in his or her throwing ability. Even an expert player may note improvements in his game inasmuch as the regions of the board to which are attributed the highest point values are typically obstructed by many boundary wires.

The deflection of a point to circumvent a boundary wire is effective to improve the chances of dart penetration only if, subsequent to the deflection, the dart still possess sufficient energy to do the work required to achieve point insertion. This may be assured by utilzing another aspect of the present invention which employs an inertial impactor to supply energy to the dart subsequent to point deflection, thereby assuring that the reoriented dart possesses ample energy for point insertion into the target. Although this feature of the invention may be used independent of the point deflection apparatus to increase dart penetration and thereby decrease dart "fall out", the fact that the impactor supplies energy to the dart subsequent to the dart's initial contact with the targe means that these features of the invention operate synergistically.

It is, therefore, a feature of the invention to provide a recreational dart capable of achieving point penetration even after impact with a non-yielding region of the target board. The dart includes an elongate body component disposed along a longitudinal axis, having a rearward portion for supporting a flight and a forwardly positioned, off-axis drive delimiter chamber of a predetermined length and transverse dimension disposed about the axis. The delimiter chamber extends between a point retention portion and an impact surface the impact surface being a conical camming surface having an apex angle selected between about 5° and 150°. By employing a point having a rearward retainer end located within the drive delimiter chamber and retractable slidably movable into abutment with the impact surface, a control deflection of the point from its normally biased position in alignment with the longitudinal axis to a new orientation a predetermined angle offset from the axis may be derived in response to tip contact with, for example, one of the target board boundary wires. The result is a new orientation of the point and possible penetration into a yielding portion of the target.

Another feature of the invention relates to a recreational dart that achieves improved penetration into a board. The dart includes a body component having an internal cavity disposed along a longitudinal axis and extending to a rearward end for supporting a flight and a forward portion configured for supporting a point coaxially with the longitudinal axis. A stop portion is provided as a discrete stop member which is positioned adjacent the body component rearward end and has a forwardly disposed contact surface communicating with the cavity and a rearward end configured for receiving the flight, and the body component is configured for receiving the stop member. An impact transmitting portion, having a rearwardly disposes drive surface, is positioned at the forward portion of the body component. An impactor is positioned within the cavity and is freely slidably movable therewithin along the longitudinal axis. The impactor has a forward impact portion movable into abutting, force transmitting contact with the drive surface and a rearwardly disposed seating portion movable into contact with the stop member contact surface. The impactor seating portion is normally biased at a position substantially in abutting adjacency with the stop member contact surface. Upon dart impact with a target and consequent deceleration, the impactor, freely slidable within the cavity, may be impelled as a result of its inertial momentum with a force sufficient to overcome its normal bias. The impactor so impelled may thusly be displaced from its normally biased position into a forward transient position in abutting contact with the impact transmitting component drive surface to thereby effect a force transfer therebetween. This force transfer imparts additional energy to the dart to derive penetration improved over that effected initially upon dart impact with the target.

Another feature of the invention is addressed to a recreational dart possessing the inventive aspects of the previously summarized features. The dart includes a rearwardly positioned internal cavity and a forwardly positioned off axis drive delimiter chamber. In a preferred embodiment, the impact transmitting portion is positioned intermediate the impactor cavity and the off axis delimiter chamber, and has a rearwardly disposed drive surface in communication with the cavity and a forwardly disposed impact surface in communication with the delimiter chamber. A dart so embodied, going to the aforementioned synergy of the point deflection and the impactor force transfer, is insured of possessing sufficient energy subsequent to point deflection to achieve penetration upon point reorientation.

Other objects of the invention will, in part, be obvious and will, in part, appear hereinafter.

The invention, accordingly, comprises the apparatus possessing the construction, combination of elements, and arrangement of parts which are exemplified in the following detailed disclosure. For a fuller understanding of the nature and objects of the invention, reference should be had to the following detailed description taken in connection with the accompanying drawings.

DETAILED DESCRIPTION

In the discourse to follow, a recreational dart having highly effective target penetration characteristics is described, initially with respect to the utilization of a high density impactor which is retained within the hollow body of the dart itself. The discourse then turns to a front end configuration of the dart wherein a failure to achieve target penetration due to the striking of a thin scoring boundary wire by the tip of the dart point is accommodated for. This loss of target phenomenon sometimes is referred to as "bounce out". Finally, the physics associated with the performance of the dart thus described is considered. While a number of targets may be contemplated for use with the dart described herein, conventional cellulosic fiber targets or their equivalent are considered. In particular, those targets conventionally are geometrically arranged to define scoring regions by a network-like wire structure which is attached to the outer surface of the board. Thus, a target will have "yielding" regions not blocked by the wire scoring network and "non-yielding regions" represented by such a wire scoring periphery. The diameter of such non-yielding wire components may, for example, be about 0.065 in.

Figure 1:
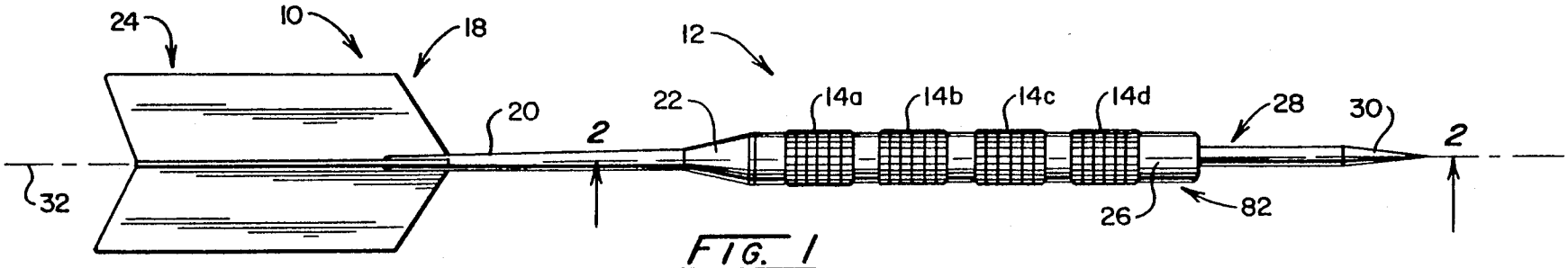
FIG. 1 is a perspective view of a recreational dart according to the present invention.

Referring to FIG. 1, a dart is represented in general at 10 as including a centrally disposed elongate body component 12 which will be seen to be hollow and, preferably, is formed of a metal material of substantially high density, for example, depleted uranium. The body 12 is shown having four knurled surface regions 14*a*–14*d*, which provide both a modicum of ornamentation as well as a frictionless grip region for the dart user. Removably attached to the rearward portion 16 of the body 12 is a flight represented generally at 18. Flight 18 includes a stem 20 having an engaging end represented at 22 which is threadably connected to the rearward portion 16 of body component 12. Stem 20 also supports three aerodynamic veins or "feathers" represented generally at 24. The "feathers" as at 24 may be formed of avian feathers or from a plastic material depending upon the desires of the dart designer.

Body component 12 also extends to a forward portion represented at 26 which serves to support a point represented generally at 28 having a sharply honed tip 30. Under "normal" supportive conditions, the point 28 will be in alignment with the central axis of the dart represented at 32. Note, additionally, that the cylindrically shaped elongate body portion 12 is concentric with this axis 32 as is the generally cylindrically shaped stem 20.

Figure 2:
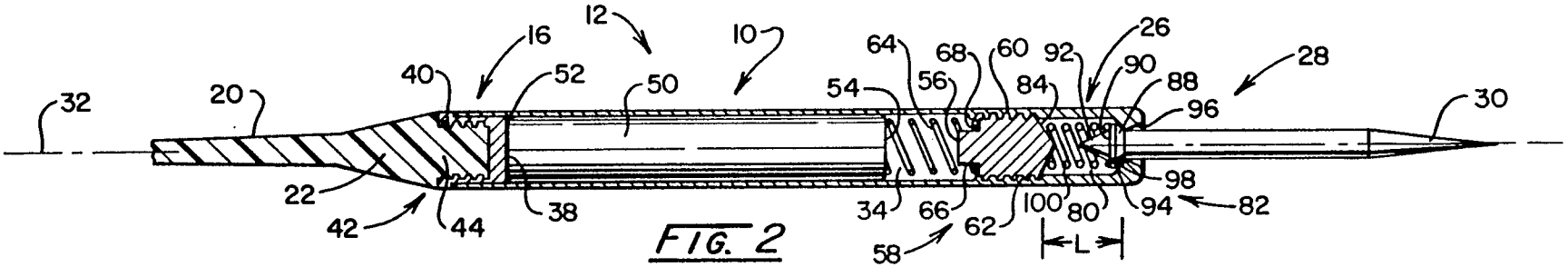
FIG. 2 is a sectional view of the dart of FIG. 1 showing the orientation of components as normally maintained.
Figure 3:
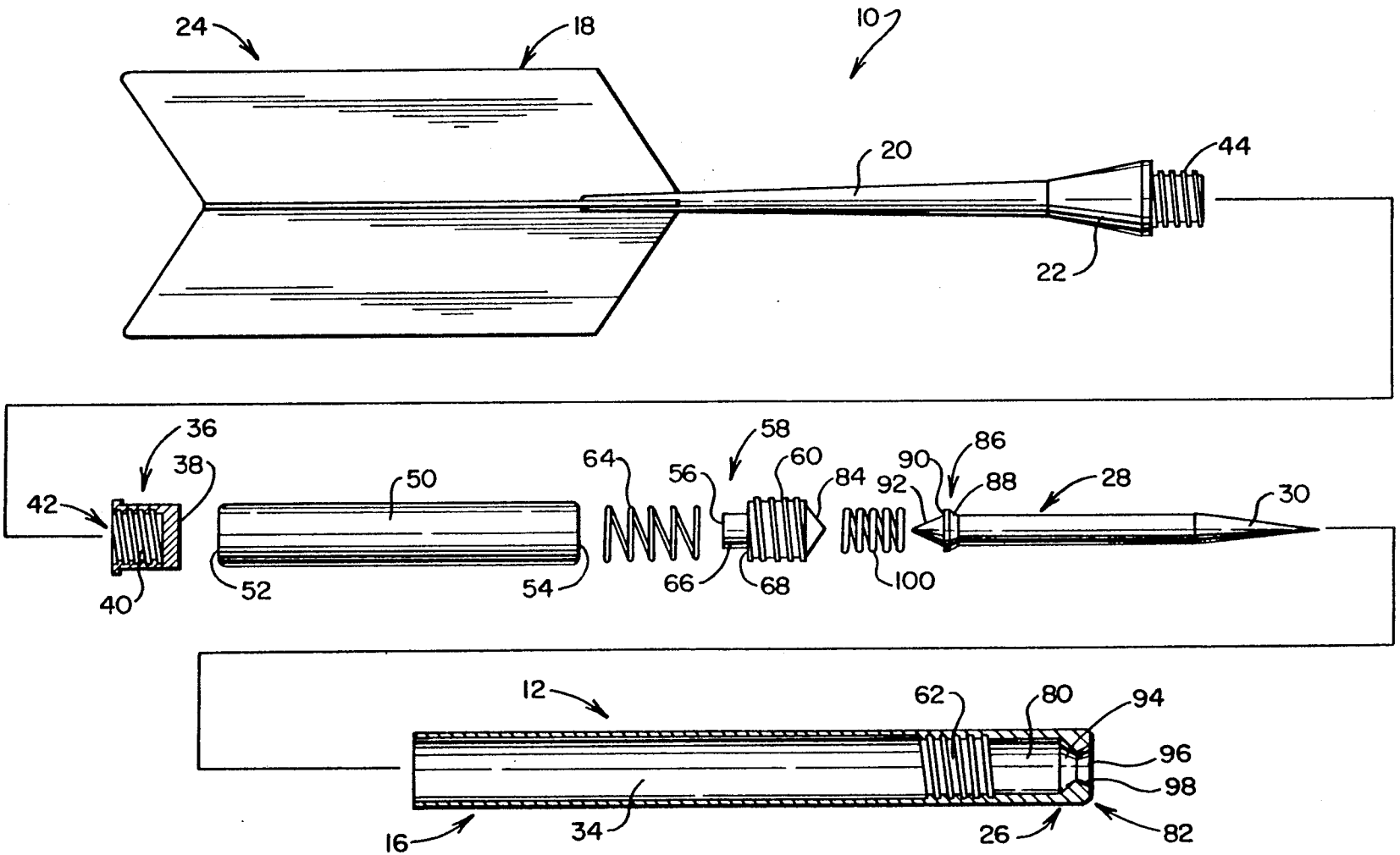
FIG. 3 is an exploded and partially sectional view of one embodiment of a dart according to the invention.

Looking to FIGS. 2 and the exploded view shown in FIG. 3, body component 12 is seen to be hollow, having a cavity 34 disposed internally therein which is of a generally cylindrical shape. Closing the rearward end of this cavity 34 is a stop portion or stop component represented generally at 36. Component 36 is of a cylindrical configuration having a forwardly disposed circular contact surface 38 and is internally bored and tapped to provide internally disposed threads 40 to provide a female receptacle represented generally at 42 adapted to receive the threaded male stud component 44 of the flight stem 20. Stop portion or component 36 may, for example, be formed of brass, the threaded interior receptacle 42 thereof being coated having, for example, a titanium nitride finish. Attachment of the stop component 36 to the rearward portion 16 of body component 12 may, for example, be by pressing or swaging. Those techniques are suitable inasmuch as a softer brass metal is engaged with a harder, more dense metal such as depleted uranium.

Within the cavity 34 there is positioned a cylindrically shaped impactor 50. Impactor 50 is slideable within the cavity 34 and to facilitate that slideability, may be provided with a self-lubricating, non-galling finish as may be derived, for example, by a chrome or tin plating or teflon filing coating. Impactor 50 has a rearwardly disposed seating portion 52 which is movable into abutting engagement with the forwardly facing contact surface 38 of stop component 36. Correspondingly, the impactor 50 provides a forward impact portion represented at surface 54 which is movable along the axis 32 into impacting engagement with the rearwardly disposed drive surface 56 of an impact transmitting portion or component 58. Impact transmitting component 58 is connected within the cavity 34 of body portion 12 by virtue of the threaded engagement between externally formed threads 60 and corresponding internal threads 62 formed within the cavity 34 (see FIG. 3).

Impactor 50 preferably is formed of a high density material such as depleted uranium and is normally biased such that its seating surface or portion 52 is in abutment with the corresponding contact surface of stop component 36 as shown in FIG. 2. This normal bias is provided, for example, by a helical spring 64 located between impact portion or surface 54 and the impact transmitting component 58. Note, that the latter component 58 is necked down to define an aligning post portion 66 which extends outwardly from an integrally formed annular receiving shoulder 68.

With the configuration shown, the high density impactor 50 imparts to the dart 10 a dynamic action similar to a dead blow hammer. In this regard, as the dart 10 is propelled towards a target, the impactor 50 is retained in its normal position as represented in FIG. 2 wherein the seating portion 52 is in engagement with the contact surface 38 of the stop portion 36. However, as the tip 30 of point 28 commences to engage the target to which the dart 10 is thrown and deceleration thereof ensues, the momentum of the high density impactor 50 will create a relative movement, in effect causing it to slide forwardly within cavity 34 compressing the spring 64 and striking the drive surface 56 of impact transmitting component 58. Thus, a force transfer is effected whereby the impactor 50 surrenders it inertial energy to the impact transmitting component 58, thereby deriving subsequent point-tip penetration improved over that achieved initially upon tip 30 impact with the target.

Now considering the forward components of the dart 10, the needle 28 for conventionally structured darts will have a length of about one inch or less. The tip 30 will have been honed to exhibit a sharp point and it is intended to penetrate the yielding portion of the target to which the dart is thrown. Where the point strikes a wire formed scoring boundary, then the dart may not penetrate the target and the throw will be lost. The import of the point 28 for the dart 10 resides in an arrangement wherein the point is permitted to move out of coaxial alignment with the central axis 32 and, in effect, "move around" the scoring boundary wire of the target.

Looking again to FIGS. 2 and 3, the forward portion of body component 12 is seen to incorporate an off-axis drive delimiter chamber represented generally at 80. Delimter chamber 80 is seen to extend to define a length generally represented as, L, from a point retention portion represented generally at 82 formed within body component 12 and an impact surface 84 which, for the instant embodiment, is shown as a conical camming surface formed as the forward portion of the impact transmitting component 58. To retain the point 28 in its normal orientation coaxially aligned with axis 32, the point is configured having a rearward retainer end represented generally at 86. Rearward retainer end 86 is configured to include a conically surfaced annular shoulder 88, the rearward surface of which serves as a bias receiving surface 90 and is formed perpendicularly to the central axis of point 28. Extending integrally from the surface 90 is a follower drive surface 92 which, for the instant embodiment, is shown as a conical camming surface.

Tip 28 is normally biased forwardly such that the annular shoulder 88 is biased against an aligning annular receiving surface 94 which is revealed, for example, in FIG. 3. Looking to that figure, it may be observed that the point retention portion 82 of the delimiter chamber 80 surmounts an aperture or opening 96 having conical or flared sides 98. With this arrangement, the point 28, when shoulder 88 is in abutment with receiving surface 94 is aligned with axis 32. However, any deflection of the tip 30 of point 28 is accommodated or permitted by virtue of the flared conical sides 98 surmounting opening 96. Bias is supplied to the point 28 by virtue of a helical spring 100 which is seen to extend in compression between impact surface 84 and bias receiving surface 90. Thus, the point 28 is normally biased into an orientation in alignment with axis 32. However, should the tip 30 of point 28 strike a non-yielding component of the target to which dart 10 is thrown, then it is permitted to deflect and such deflection, in effect, is enhanced by the stucturing of the forward portion of the dart.

Figure 4:
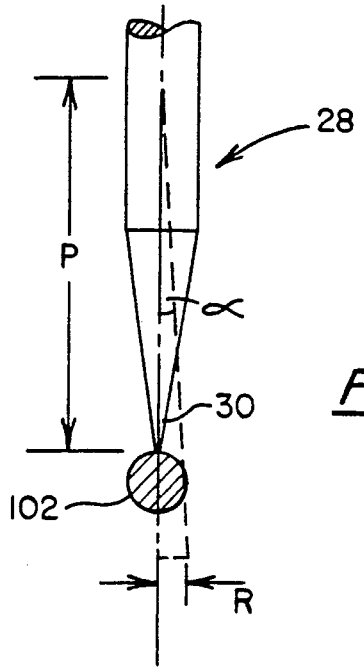
FIG. 4 is a schematic representation of the tip of the dart of FIG. 2 shown in adjacency with a dart board boundary scoring wire.

Looking momentarily to FIG. 4, the tip 30 is shown in adjacency with a section of scoring boundary wire depicted schematically at 102. Should the sharpened point or tip 30 strike boundary wire 102 or the non-yielding portion of the target directly, then it is desirable that the point 28 deflect an amount sufficient for the tip 30 to penetrate the adjacent yielding portion of the target in avoidance of wire 102. This requires a deflection at least corresponding with a solid angle as represented at $\alpha$. For a point 28 having a length, P, for example, of about one inch, the extent of such required deflection for a boundary wire having, for example, a diameter of 0.065 in. (radius, R), of about 1.5° or more is desired. In practice, it is desirable that the extent of deflection be from that minimum value of about 1.5° to, for example, a maximum valuation of about 45°. A deflection capability of about 15° generally is elected. To achieve a requisite deflection of point 28, the length, L, of the delimiter chamber is selected in correspondence with the transverse dimension or diameter thereof to permit the noted deflection at least by angle, $\alpha$. Thus, as the point engages the non-yielding target region or wire 102, then it will commence to retract such that the retainer end 86 moves slidably rearwardly within the chamber 80 to permit the commencement of deflection. This motion generally will continue until the follower drive surface 92 engages impact surface 84. Note that the impact surface 84 is of a conical configuration such that it performs somewhat in the nature of a camming surface encouraging or enhancing the off-axis movement of follower drive surface 92 into what may be considered a stable orientation of the point 28 limited by its orientation within the chamber 80. The facility for off axis deflective movement as described is controlled by the diametric or transverse extent of annular shoulder 88 of the point 28, the noted length L, and the interrelationship of camming surface 84 and follower drive surface 92. For example, the slope of impact surface 84 may be identified by its apex angle. This solid angle, preferably, falls within a range from a minimum of about 5° representing a highly deflectable arrangement, to a maximum of about 150° representing a slower or more progressive displacement.

Figure 5:
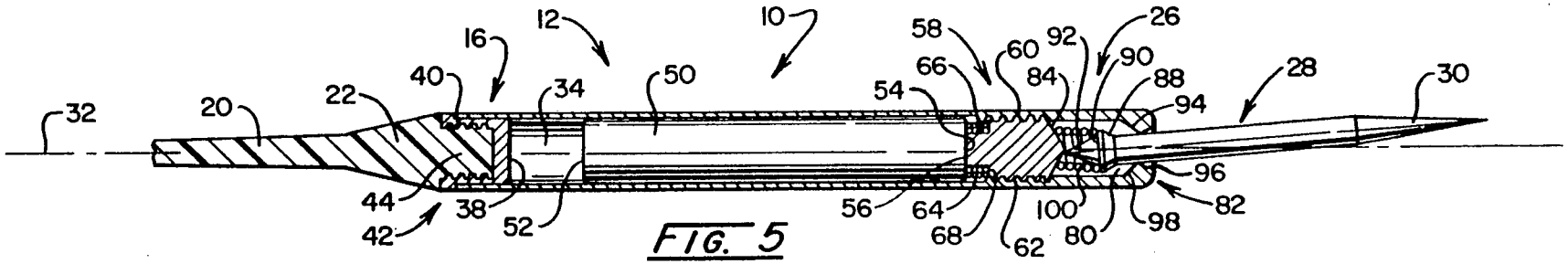
FIG. 5 is a sectional view of the dart of FIG. 2 showing the orientation of components in their actuated state immediately following dart impact.

Looking to FIG. 5, a sectional representation of the dart 10 is shown illustrating the orientation of the components in the terminal dynamic stages of contact of the point 28 with a target and following its deflection from a non-yielding portion of the target. Note in the figure that the point 28 has been deflected and this deflection is enhanced by virtue of the contact of follower drive surface 92 of point 28 with the conical impact surface 84 of impact transmitting component 58. In this orientation, the spring 100 has been compressed. Spring 100 generally is selected to have a spring constant which permits the point 28 to remain in its normal orientation as represented in FIG. 2 when it is penetrating the yielding portion of a target. It is when the point 28 contacts a non-yielding portion such as a scoring boundary wire that the spring will yield to the orientation shown in FIG. 5. Note, additionally, in FIG. 5, that the impactor 50 has moved forwardly to contribute dynamic force to the driving of point 28 into the target. In this regard, spring 64 has been compressed about the aligning post portion 66 of component 58. This geometry protects the spring and provides an improved contacting association between the impactor 50 and the drive surface 56.

Figure 6:
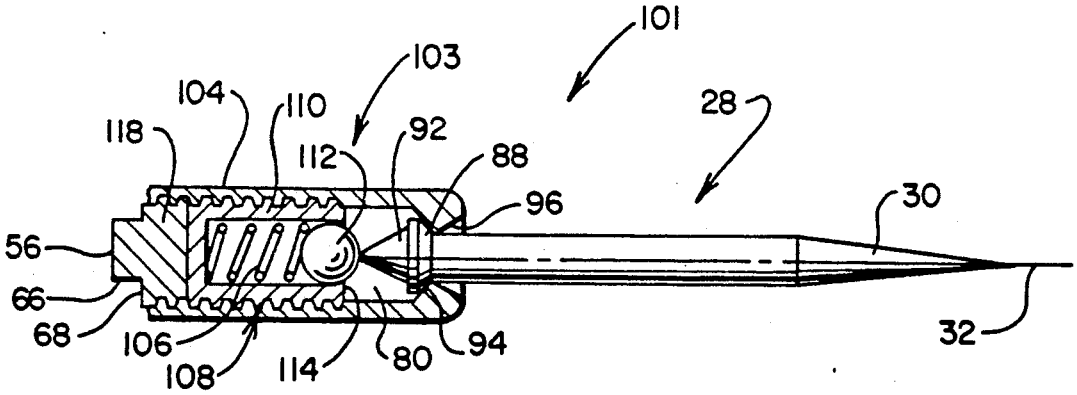
FIG. 6 is a partial sectional view of an alternate embodiment of a recreational dart according to the invention.

Referring to FIG. 6, another embodiment for a dart 101 forward portion structuring is revealed. In the figure where appropriate, the same numeration is employed to describe identical parts heretofore discussed in detail. In this regard, point 28 again is represented by that numeration and is seen to be normally symmetrically disposed about longitudinal axis 32 and extends at one end to a tip 30. The opposite end of the point 28 is configured having a conically surfaced annular shoulder 88 as before as well as a follower drive surface 92. The point 28 nests, as before, against an annular conically shaped receiving surface 94 formed within the forward portion 103 of the body component 104 of the dart embodiment 100. Thus, the point 28 is normally biased into an orientation concentric with the longitudinal axis 32 of the dart. This bias is supplied by a helical spring 106 which forms a component of a spring-ball device represented generally at 108 and including an externally threaded housing 110 and a steel sphere or ball 112. The ball 112 is forwardly biased by a slight compression of the spring 106 and is retained in the orientation shown by an annular opening of diameter less than the sphere at 114 which is formed as part of the housing 110. The structure 108 will be recognized as one component of a device used commercially as a cabinet door latch. The ball 112 is seen to be contacting the tip of the follower drive surface 92 of point 28 to provide the noted bias holding the point 28 in its normal orientation of axial alignment. However, should the point tip 30 strike a non-yielding portion of the target, deflection of it from its normal axial alignment will be enhanced by the surface of ball 112 engaging the follower drive surface 92. Rearwardly of the device 108 there is provided an insert 118 which is configured to provide the function of the earlier-described drive surface 56, aligning post portion 66, and receiving should 68.

Next addressed are the physics of a dart configured as represented in FIGS. 2 and 5. In throwing a dart, energy is supplied to the dart by the thrower and work is done by the dart in penetrating the target. By dropping darts of known masses from varied vertical heights and observing their penetration into a board, the amount of energy necessary to effect a penetration can be determined by using the relationship that potential energy equals the mass of the dart times its vertical displacement. Considering a 20 g dart, a popular mass, an energy of 2.5 million ergs was found to be sufficient to cause a dart to penetrate into a conventional board.

The energy possessed by a dart in flight can be determined using the relationship that kinetic energy equals one-half the dart's mass times its velocity squared. Assuming, for the purposes of this discussion, that a dart of the instant embodiment has a body component 12 mass of 10 g, an impactor 50 mass of 16 g, and a velocity in the range of about 1,000 to 1,700 cm per second, it can be found that body component 12 possesses 5 to 14 million ergs of energy and impactor 50 possesses 8 to 23 million ergs of energy at target impact. Consequently, either component has sufficient energy to guarantee a penetration into the target. However, upon point 28-tip 30 impact with a non-yielding portion of the target, work is also done in compressing helical spring 100 and in deflecting point 28 from its normal position in alignment with central axis 32. The amount of energy necessary to do this work is dependent upon a characteristic of the spring selected known as a spring constant which is roughly a measure of the relative stiffness of the spring. Even assuming a spring with a spring constant of a value such that the entire 5 to 14 million ergs of kinetic energy possessed by body component 12 is utilized in spring 100 compression and in point 28 deflection, the 8 to 23 million ergs of energy possessed by impactor 50 is still well above the 2.5 million ergs needed to achieve dart 10 penetration into the board.

Moreover, the fact that impactor 50 has a forwardly directed velocity relative to point 28 and body component 12 upon tip 30 contact with a non-yielding portion of the target and consequent point 28 and body component 12 deceleration, means that the energy transferred from impactor 50 to body component 12 and point 28 through impact transmitting component 58 is not effected until a time subsequent to tip 30 off axis deflection. Assuming a total deceleration of point 28 and body component 12 upon tip 30 impact with a non-yielding portion of a target, an impactor travel distance of .5 cm from its normally biased position as represented in FIG. 2 to its energy transfer position as represented in FIG. 5, and a dart 10 velocity 1,000 cm per second, the energy transfer from impactor 50 would occur some 500 microseconds after tip 30 initial contact with the target. This time delay assures a point 28 deflection prior to dart 10's re-energization by impactor 50. This increases the statistical probability that tip 30 will contact an adjacent region of the target, i.e. a yielding one into which penetration may be achieved.

I claim:

1. A recreational dart comprising:

a body component having an internal cavity therein disposed along a longitudinal axis, said body component extending to a rearward end for supporting a flight and to a forward portion configured for supporting a point coaxially with said longitudinal axis;

a stop portion, provided as a discrete stop member, positioned adjacent said body component rearward end and having a forwardly disposed contact surface communicating with said cavity and a rearward end configured for receiving said flight, and said body component being configured for receiving said stop member;

an impact transmitting portion positioned at said body component forward portion and having a rearwardly disposed drive surface;

an impact transmitting portion positioned at said body component forward portion and having a rearwardly disposed drive surface;

an impactor positioned within said cavity and freely slideably moveable therewithin along said longitudianal axis, having a forward impact portion moveable therewith into abutting, force transmitting contact with said drive surface and a rearwardly disposed seating portion moveable therewith into contact with said stop member contact surface; and biasing means for normally biasing said impactor seating portion at a position substantially in abutting adjacency with said stop member contact surface.

2. The recreational dart of claim 1 wherein said stop member contact surface is planar and perpendicular to said impactor seating portion.

3. The recreational dart of claim 1 wherein:

said impact transmitting portion comprises a receiving shoulder disposed about said drive surface and an aligning post extending to said drive surface; and said biasing means is a helical spring disposed along said longitudinal axis, said spring having a rearward end disposed adjacent said impactor impact portion, a forward portion mounted coaxially over said impact transmitting component aligning post, and a forward end located in abutting adjacency with said impact tranmitting component receiving shoulder.

4. The recreational dart claim 1 wherein:

said internal cavity disposed within said body component is of a cylindrical cross-section; and said impactor is of a cylindrically shaped, high density metallic material.

5. The recreational dart of claim 4 wherein said high density impactor is formed of depleted uranium.

6. The recreational dart of claim 1 wherein said impact transmitting portion is a discrete impact transmitting component configured for threadable engagement with said elongate body component.

7. The recreational dart of claim 1 wherein said body component is formed of depleted uranium.

8. The recreational dart of claim 1 wherein said body component and said high density impactor are formed of depleted uranium.

9. A recreational dart for use with a target having yielding and non-yielding regions comprising:

a body component disposed along a longitudinal axis, having a rearward portion for supporting a flight and a forwardly positioned, off-axis drive delimiter chamber of predetermined length and transverse dimension disposed about said axis, said delimiter chamber extending between a point retention portion and an impact surface, said impact surface being a conical camming surface having an apex angle selected between about 5° and 150°;

a point having a forward tip for penetration into said target and a rearward retainer end, said rearward retainer end being located within said delimiter chamber, positioning said tip in alignment with said axis when in abutting engagement with said point retention portion, and retractively and slideably movable within said chamber into abutment with said impact surface, orienting said tip to define a predetermined offset angle from said axis is response to contact of said tip with a said non-yielding region of said target; and biasing means for applying a forwardly direction bias to said point rearward retainer end, urging it into freely abutting engagement with said chamber point retention portion.

10. The recreational dart of claim 9 wherein said point rearward retainer end includes a follower drive surface slideably abuttably engageable with said chamber impact surface upon said retractive movement of said point.

11. The recreational dart of claim 10 wherein said follower drive surface is a conical with an apex angle selected between about 5° and 150°.

12. The recreational dart of claim 10 wherein:

said point retainer end has an annular shoulder disposed about said follower drive surface; and said body component point retention portion has an annular surface configured for receiving said annular shoulder.

13. The recreational dart of claim 12 wherein said annular shoulder has an outer periphery of a diametric extent with respect to that of said off-axis drive delimiter chamber to limit said point tip angular offset.

14. The recreational dart of claim 9 wherein said biasing means comprise a spring mounted within said delimiter chamber intermediate said point rearward retainer end and said impact surface.

15. The recreational dart of claim 14 wherein said spring has a spring constant selected to maintain said point in said abutting engagement with said point retention portion upon point contact with a yielding portion of the target.

16. The recreational dart of claim 9 wherein said biasing means comprise a spring mounted within said delimiter chamber and oriented to urge said impact surface against said point rearward retainer end.

17. A recreational dart for use with a target having yielding and non-yielding regions, comprising:

a body component disposed along a longitudinal axis, extending to a rearward end for supporting a flight and to a forward portion, said forward portion including an off-axis drive delimiter chamber of predetermined length and transverse dimension disposed about said axis and extending between a point retention portion and an impact surface, said impact surface being a conical camming surface having an apex angle selected between about 5° and 150°, said body component including an internal cavity disposed along said axis extending rearwardly from said forward portion;

a point having a forward tip for penetration into said target and a rearward retainer end, said rearward retainer end being located within said delimiter chamber, positioning said tip in alignment with said axis when in abutting engagement with said point retention portion, and retractively and slideably movable within said chamber into abutment with said impact surface, orienting said tip to define a predetermined offset angle from said axis in response to contact of said tip with a said non-yielding region of said target;

first biasing means for applying a forwardly directed bias to said point rearward retainer end, urging it into freely abutting engagement with said chamber point retention portion;

a stop portion positioned adjacent said body component rearward end and having a forwardly disposed contact surface communicating with said cavity and a rearward end;

an impact transmitting portion positioned at said body component forward portion and having a rearwardly disposed drive surface;

an impactor positioned within said cavity and freely slideably moveable therewithin along said longitudinal axis, having a forward impact portion moveable therewith into abutting, force transmitting contact with said drive surface and a rearwardly disposed seating portion moveable therewith into contact with said stop member contact surface; and second biasing means for normally biasing said impactor seating portion at a position substantially in abutting adjacency with said stop member contact surface.

18. The recreational dart of claim 17 wherein:

said stop portion is a discrete stop member;

said body component rearward end is configured for receiving said stop member; and said stop member rearward end is configured for receiving a flight.

19. The recreational dart of claim 18 wherein said stop member contact surface is planar and perpendicular to said impactor seating portion.

20. The recreational dart of claim 17 wherein:

said impact transmitting portion comprises a receiving shoulder disposed about said drive surface and an aligning post extending to said drive surface; and said second biasing means is a helical spring disposed along said longitudinal axis, said spring having a rearward end disposed adjacent said impactor impact portion, a forward portion mounted coaxially over said impact transmitting component aligning post, and a forward end located in abutting adjacency with said impact transmitting component receiving shoulder.

21. The recreational dart of claim 20 biasing means is a helical spring having a spring constant of a value effective to maintain said impactor at said normally biased position and compressible by said impactor into a compressed orientation wherein said impactor impact portion is in abutting force transmitting contact with said impact transmitting component drive surface, said impactor being impelled upon dart impact and consequent point, body component and impact transmitting component deceleration with a force sufficient to overcome said spring biasing force such that said impactor is displaced from its normally biased position into abutting contact with said impact transmitting component to effect a force transfer therebetween.

22. The recreational dart of claim 17 wherein said impact transmitting portion is a discrete impact transmitting member, includes said impact surface and is threadably engageable with said body component.

23. The recreational dart of claim 17 wherein said impactor is formed of depleted uranium.

24. The recreational dart of claim 17 wherein said body component is formed of depleted uranium.

25. The recreational dart of claim 17 wherein said body component and said high density impactor are formed of depleted uranium.

26. A recreational dart comprising:

a body component having an internal cavity therein disposed along a longitudinal axis, said body component extending to a rearward end for supporting a flight and to a forward portion configured for supporting a point coaxially with said longitudinal axis;

a stop portion positioned adjacent said body component rearward end and having a forwardly disposed contact surface communicating with said cavity and a rearward end;

an impact transmitting portion positioned at said body component forward portion and having a receiving shoulder disposed about a rearwardly disposed drive surface and an aligning post extending to said drive surface;

an impactor positioned within said cavity and freely slideably moveable therewithin along said longitudinal axis, having a forward impact portion moveable therewith into abutting, force transmitting contact with said drive surface and a rearwardly disposed seating portion moveable therewith into contact with said stop member contact surface; and biasing means for normally biasing said impactor seating portion at a position substantially in abutting adjacency with said stop member contact surface and including a helical spring disposed along said longitudinal axis, said spring having a rearward end disposed adjacent said impactor impact portion, a forward portion mounted coaxially over said impact transmitting component aligning post, and a forward end located in abutting adjacency with said impact transmitting component receiving shoulder.

27. The recreational dart of claim 26 wherein said impact transmitting portion is a discrete impact transmitting member threadably engageable with said body component.

28. The recreational dart of claim 26 wherein said helical spring has a spring constant of a value effective to maintain said impactor at said normally biased position and compressible by said impactor into a compressed orientation wherein said impactor impact portion is in abutting force transmitting contact with said impact transmitting component drive surface, said impactor being impelled upon dart impact and consequent point, body component and impact transmitting component deceleration with a force sufficient to overcome said spring biasing force such that said impactor is displaced from its normally biased position into abutting contact with said impact transmitting component to effect a force transfer therebetween.

29. A recreational dart for use with a target having yielding and non-yielding regions comprising:

a body component disposed along a longitudinal axis, having a rearward portion for supporting a flight and a forwardly disposed, off-axis drive delimiter chamber of predetermined length and transverse dimension disposed about said axis, said delimiter chamber extending between a point retention portion and an impact surface;

a point having a forward tip for penetration into said target and a rearward retainer end, said rearward retainer end being located within said delimiter chamber and including a follower drive surface of conical shape with an apex angle selected between 5° and 150°, positioning said tip in alignment with said axis when in abutting engagement with said point retention portion, and retractively and slideably movable within said chamber to effect an abutment of said follower drive surface with said impact surface, retracting and orienting said tip to define a predetermined offset angle from said axis in response to contact of said tip with a said non-yielding region of said target; and biasing means for applying a forwardly directed bias to said point rearward retainer end, urging it into freely abutting engagement with said chamber point retention portion.

30. A recreational dart for use with a target having yielding and non-yielding regions, comprising:

a body component disposed along a longitudinal axis, extending to a rearward end for supporting a flight and to a forward portion, said forward portion including an off-axis drive delimiter chamber of predetermined length and transverse dimension disposed about said axis and extending between a point retention portion and an impact surface, said body component including an internal cavity disposed along said axis extending rearwardly from said forward portion;

a point having a forward tip for penetration into said target and a rearward retainer end, said rearward retainer end being located within said delimiter chamber, positioning said tip in alignment with said axis when in abutting engagement with said point retention portion, and retractively and slideably movable within said chamber into abutment with said impact surface, orienting said tip to define a predetermined offset angle from said axis in response to contact of said tip with a said non-yielding region of said target;

first biasing means for applying a forwardly directed bias to said point rearward retainer end, urging it into freely abutting engagement with said chamber point retention portion;

a stop portion positioned adjacent said body component rearward end and having a forwardly disposed contact surface communicating with said cavity and a rearward end;

an impact transmitting portion positioned at said body component forward portion and having a receiving shoulder disposed about a rearwardly disposed drive surface and an aligning post extending to said drive surface;

an impactor positioned within said cavity and freely slideably moveable therewithin along said longitudinal axis, having a forward impact portion moveable therewith into abutting, force transmitting contact with said drive surface and a rearwardly disposed seating portion moveable therewith into contact with said stop member contact surface; and second biasing means for normally biasing said impactor seating portion at a position substantially in abutting adjacency with said stop member contact surface and including a helical spring disposed along said longitudinal axis, said spring having a rearward end disposed adjacent said impactor impact portion, a forward portion mounted coaxially over said impact transmitting component aligning post, and a forward end located in abutting adjacency with said impact transmitting component receiving shoulder.

* * * * *